United States Patent [19]

Diehl

[11] Patent Number: 4,694,765

[45] Date of Patent: Sep. 22, 1987

[54] ADJUSTABLE APPARATUS FOR SEWING MACHINE THREAD TENSIONING DEVICE

[75] Inventor: Konrad Diehl, Bexbach, Fed. Rep. of Germany

[73] Assignee: Pfaff Industriemaschinen GmbH, Fed. Rep. of Germany

[21] Appl. No.: 892,481

[22] Filed: Aug. 1, 1986

[30] Foreign Application Priority Data

Aug. 16, 1985 [DE] Fed. Rep. of Germany ..... 3529369

[51] Int. Cl.[4] ..... D05B 47/02

[52] U.S. Cl. ..... 112/254; 242/150 R

[58] Field of Search ..... 112/254, 238, 255; 242/150 R

[56] References Cited

U.S. PATENT DOCUMENTS

| | | | |
|---|---|---|---|
| 3,150,846 | 9/1964 | Laidig | 112/254 X |
| 3,472,190 | 10/1969 | Gegauf | 112/254 |
| 4,611,547 | 9/1986 | Kurzamoto | 112/254 |

FOREIGN PATENT DOCUMENTS

| | | | |
|---|---|---|---|
| 610638 | 12/1933 | Fed. Rep. of Germany . | |
| 1704789 | 5/1955 | Fed. Rep. of Germany . | |
| 800727 | 9/1958 | United Kingdom | 242/150 |

*Primary Examiner*—H. Hampton Hunter
*Assistant Examiner*—Andrew M. Falik
*Attorney, Agent, or Firm*—McGlew and Tuttle

[57] ABSTRACT

A sewing machine is equipped with a needle thread tensioning device which has two gripping discs mounted on a pin. The gripping discs are connected via a spring mechanism with two adjusting members on the same axis capable of movement relative to one another, of which at least one is mounted on a threaded section of the pin. In addition, the tensioning device has a mechanism for occasional suspension of the effect of the spring. With the tensioning device, in spite of the common mounting of both the adjusting members on the same pin, two tensions of varying degrees, a main tension and an auxiliary tension, can be adjusted and transmitted to the needle thread independently of one another and quickly switched one for the other. For this purpose, the two adjusting members are designed as inner and outer parts and separated from one another by a stationary support placed between the inner and the outer part. Each of these adjusting members is associated with a spring, a release disc and a mechanism for graduated release of the thread tension.

10 Claims, 4 Drawing Figures

ADJUSTABLE APPARATUS FOR SEWING MACHINE THREAD TENSIONING DEVICE

FIELD AND BACKGROUND OF THE INVENTION

This invention relates in general to sewing machines and in particular to a new and useful sewing machine having a device for tensioning the needle thread.

A similar sewing machine is known for German patent No. 610,638. With this arrangement, a tensioning device for the upper, or needle, thread is used that has a pin mounted in the arm of the sewing machine designed to hold two adjusting nuts, one of which serves to adjust the main tension, the other to adjust the auxiliary tension. Both adjusting nuts act as a common spring. This spring presses a release disc against two gripping discs, whereby the needle thread running between the gripping discs is subjected to the adjusted tension. In order to release the tension, the release disc is separated from the gripping discs by a peg mounted in a hole in the pin.

With the device pursuant to the patent, it is possible to reinforce the adjusted main tension with an auxiliary tension, or to transmit the auxiliary tension to the gripping discs without the main tension. On the other hand, a quick shift between two different tensions is not possible, because the sewing process must be interrupted in order to apply the desired second tension on the needle thread through at least one of the adjusting nuts.

German utility model No. 17 04 798 discloses a tensioning system wherein it is possible to adjust the main and auxiliary tension on the needle thread separately. In order to hold the two tensioning devices for the main and auxiliary tension, two pins are mounted next to one another on the housing of a sewing machine. To adjust the tension, one adjusting nut must be turned for each tensioning device. The adjusted tension is transmitted to the gripping discs via a conical spring and hence to the needle thread. By activating a wedge that can be pressed between the gripping discs and pushes them apart, the auxiliary tension can be released.

With a device like that described in the Utility Model, an adjusted auxiliary tension can be applied or released as needed, but for the purpose two tensioning devices are required per needle thread, so that with machines that have two or more needle threads a clear view of the work is reduced and the operation is complicated by the double number of tensioning devices for each.

SUMMARY OF THE INVENTION

The invention provides a device for tensioning the needle thread of a sewing machine in such a way that the main and auxiliary tensions, in spite of common mounting on one pin, can be adjusted independently of one another and quickly switched with one another.

The tensioning device pursuant to the invention offers the advantage of being applicable for sewing procedures in which two tensions of differing degrees are used, without the necessity of mounting the devices for adjusting the main and/or auxiliary tension on different pins, which is markedly advantageous in terms of a clear view of the work and ease of handling, particularly in the case of machines with two or more needles.

The adjusting members needed to adjust the different tensions are mounted separately from one another in the tensioning device pursuant to the invention, so that when one tension is adjusted, the second adjusting member is not moved correspondingly, and hence the second tension is not adjusted.

The two different tensions can be switched quickly for one another, because two release discs are provided in the tensioning device pursuant to the invention by means of which one or the other or both of the tensions applied to the two thread-holding gripping discs can be released as desired.

The release members used to operate the release discs are mounted on the outside of the housing of the sewing machine so as to be readily accessible and can be actuated by an operator mechanically, pneumatically or electromagnetically. For performing sewing procedures such as thread cutting during which the needle thread should not be under tension, the sewing machine has a regulated actuation device for actuating the release discs by shifting the release members, so that the operator does not have to assist the process.

Accordingly, an object of the invention is to provide an improved sewing machine thread tensioning device which includes two releasing members capable of releasing the portion of the tension acting on two gripping discs.

A further object of the invention is to provide a tensioning device for the needle thread of a sewing machine which includes two tensioning adjusting elements with release members for each tensioning device.

A further object of the invention is to provide a sewing machine which is simple in design, rugged in constructions and economical to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

DESCRIPTION OF THE PREFERRED EMBODIMENTS

Figure 1:
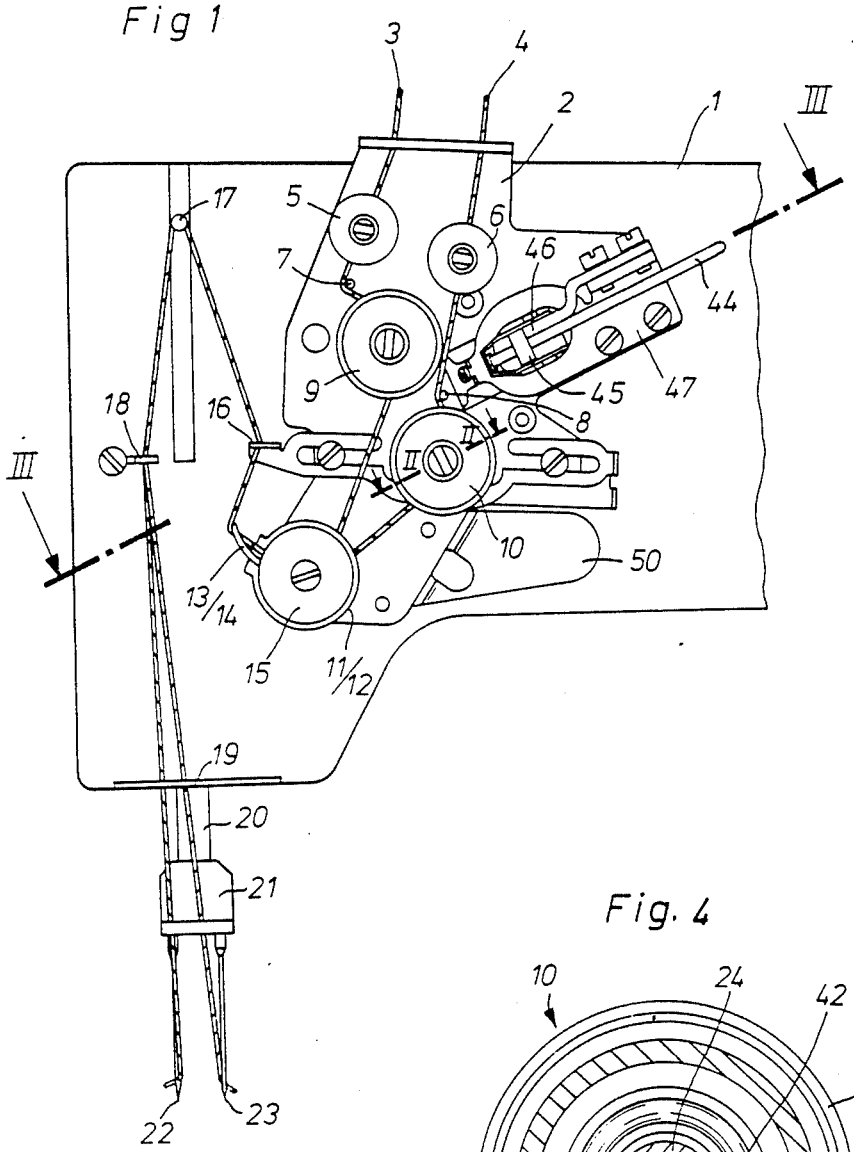
FIG. 1 is a sectional view of a sewing machine head equipped with a device for tensioning the needle thread and with various thread guiding members.

Referring to the drawings in particular, the invention embodied therein comprises a device for tensioning the needle thread 3 and 4 in a sewing machine 1 which includes a thread tensioning gripping disc 27 and 28 which may be separately adjusted by separate adjusting members such as an adjustable screw or socket 34 and an adjustable nut 36, and wherein the tension may be released by separate release members 25 and 26.

The housing 1 of a sewing machine as shown in FIG. 1 bears a plate 2 on which components for tensioning and guiding of the thread are mounted. Two threads, 3 and 4 go through holes (not shown) on the folded top of the plate 2 and run through pre-tensioning devices 5 and 6 which compensate for the backward pull on the threads from the spools (not shown). After turning around guide pegs 7, 8, the threads 3,4 are guided through tensioning devices 9,10, then turned between two guide rollers 11,12 and impinged upon by thread drawing springs 13, 14, the effect of which can be suspended by a turnable sleeve member 15.

The threads 3, 4 pass through eyes in a thread guide 16 joined to the plate 2, through a thread take-up lever 17 that moves up and down in a slot in the housing 1, through other guide members 18 and 19 attached to the housing 1, through a thread guide 21 mounted on the needle bar 20, and finally through the eyes of the needles 22, 23.

Figure 2:
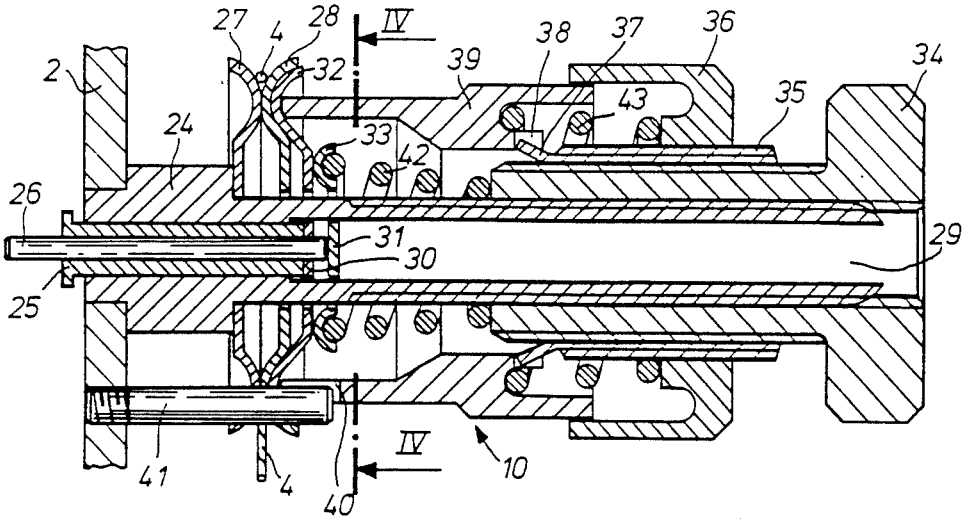
FIG. 2 is a cross-section through the tensioning device along line II—II of FIG. 1.

The tensioning device 10 as shown in FIG. 2 has a pin 24 to bear all the components required to tension the thread and is attached to the plate 2. The pin 24 which is thus, attached to the housing at its larger diameter end, has a hole to house a release member in the form of a release bar 26. The transition in cross section from the larger to the smaller diameter of the pin 24 results in a ring-shaped surface that serves as a seat for two gripping discs 27, 28.

Figure 4:
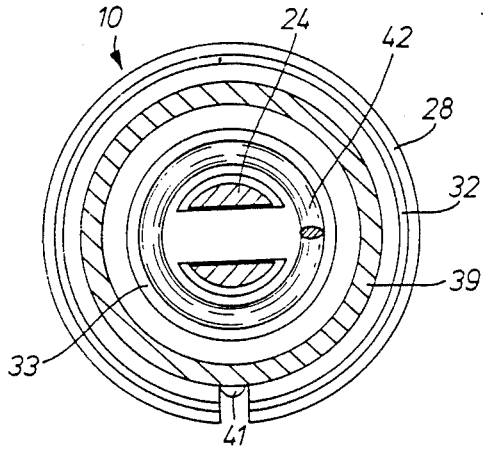
FIG. 4 is a cross-section along line IV—IV of FIG. 2 through the tensioning device to show the arrangement of the release discs.

The pin 24 has on its free end a transverse slot 29 to hold the center crosspieces 30, 31 of two release discs 32, 33 (see also FIG. 4), where release disc 32 touches gripping disc 28 and release disc 33 touches release disc 32.

The threaded end of the pin 24 bears an adjusting member in the form of an adjusting screw or socket 34 that is internally and externally threaded. The external thread of the adjusting screw or socket 34 serves to hold a bushing 35, which is also internally and externally threaded and serves as a support for the adjusting nut 36, the other adjusting member. The bushing 35 is kept from turning by projecting pieces 37 that engage in the recesses 38 of a sliding sleeve 39. The sliding sleeve 39 is also secured against turning by a projecting piece or bolt 41 attached to the plate 2 and engaging in a recess 40 in the sliding sleeve 39, which bolt 41 also keeps the gripping discs 27,28 from turning.

A conical spring 42 is positioned between the adjusting screw 34 and the release disc 33, while another conical spring 43 is bounded by the adjusting nut 36 and the sliding sleeve 39, whereby the sliding sleeve 39 guides the spring 43 in a recess and transmits the tension of the spring 43 to the release disc 32 that is in contact with the sliding sleeve 39.

Figure 3:
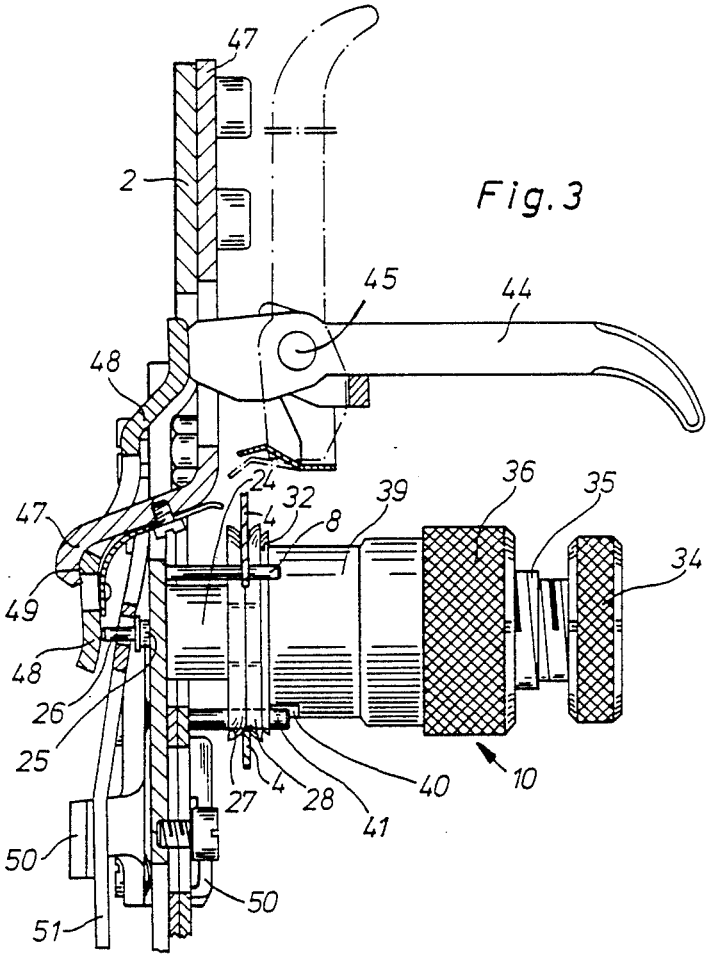
FIG. 3 is a cross-section along line III—III of FIG. 1 to show the tensioning device with the components for releasing the tension.

In FIG. 3, a clamping lever 44 is seated so that it can pivot around a bolt 45 in a mount 46 that is connected with a support 47 that is mounted on the plate 2. (See also FIG. 1). The clamping lever 44 presses in one of its two positions on a coupler 48, which is seated in an area 49 of the support 47 designed as a bearing point, and moves the release bar 26. A pressure disc 50, attached to plate 2 in such a way that it can pivot, is in contact with a coupler 51 that is mounted on the plate 2 and lies on the release sleeve 25.

The arrangement works as follows:

In order to apply the auxiliary tension, the adjusting screw 34 as shown in FIG. 2 is moved to the left. The spring 42 is thereby compressed, so that release disc 33 is pressed against release disc 32 and thereby applies an auxiliary pressure on the thread 4 that runs between the gripping discs 27 and 28.

In order to apply the main tension, the adjusting nut 36 as shown in FIG. 2 is moved to the left in order to convey the pressure thereby applied to spring 43 to the sliding sleeve 39 and thence to the release disc 32.

The release disc 32 is thereby pressed against the gripping disc 28, so that the thread that runs between the gripping discs 27 and 28 is subjected to a main pressure.

In order to release the auxiliary tension, the clamping lever 44 is pivoted from its resting position, indicated by dotted lines, to its operating position, indicated by solid lines. In operating position, the clamping lever 44 presses on the coupler 48 that it tilts on its bearing point 49 and thereby pushes the release bar 26 in the direction of the free end of the tension device 10 until release disc 33 is separated from release disc 32 and no longer exercises any pressure on the gripping discs 27,28 on which only the remaining main tension is now acting.

In order to release all tension, i.e., both the main and the auxiliary tension, pressure disc 50 is operated by being pressed back as per FIG. 1 by an operator. The coupler 51 connected with the pressure disc 50 is thereby pivoted on its point of attachment on the plate 2, causing the release sleeve 25 to be shifted in the direction of the free end of the tension device 10 until it pushes release disc 32 and release disc 33 next to it away from the gripping discs 27,28 and thus removes all pressure.

For sewing procedures in which the thread should be completely tension free, a device is mounted in the housing 1 of the sewing machine whereby the coupler 51 and hence the release sleeve 25 can be activated to release the applied tension.

While specific embodiments of the invention have been shown and described in detail to illustrate the application of the principles of the invention, it will be understood that the invention may be embodied otherwise without departing from such principles.

I claim:

1. A sewing machine tensioning device for a needle thread, comprising a mounting pin having a threaded section, first and second cooperative gripping discs mounted on said pin for tensioning a needle thread, first and second adjusting members, a release disc for each adjusting member, said first and second adjusting members being mounted on said pin on the same axis and being capable of movement with respect to one another, at least one of said adjusting members being mounted on said threaded section of said pin, a spring mechanism for adjusting the tension between said adjusting members and said release discs including a separate spring for each of said first and second adjusting members, a mechanism for occasionally suspending the effect of said spring mechanism, said second adjusting member comprising an inner part, a stationary support fitting onto said inner part, said first adjusting member comprising an outer part, said outer part fitting onto said stationary support, each of said first and second adjusting members being associated with a respective spring, said mechanism for occasionally suspending the effect of said spring mechanism including two release members mounted for movement with respect to each other and engageable with said release discs for the purpose of occasional suspension of the effect of each of said springs for a graduated release of the tensioning of the thread.

2. A device according to claim 1, wherein a sliding sleeve is positioned between one of said springs and one release disc.

3. A device according to claim 2, wherein the sliding sleeve has at least one axially oriented recess in which a projecting piece on said support engages in order to keep the support from turning.

4. A device according to claim 1, wherein said release members are mounted in an axial hole of said pin and act on cross-pieces of the release discs, said pin having a transverse slot for said cross-pieces.

5. A device according to claim 1, including a housing and wherein said release members can be moved by operating members provided on the outside of said housing and including a lever pivoted on said housing for moving said operating members.

6. A device according to claim 1, wherein said inner part is an internally threaded socket which is threaded onto said pin, said socket being externally threaded, said support being internally threaded and being threaded onto said socket, said support being externally threaded, said outer part being internally threaded and being threaded onto said support.

7. A device according to claim 1, wherein said release disc of said first adjusting member is positioned between said spring of said first adjusting member and one of said gripping discs, said release disc of said second adjusting member being positioned between said spring of said second adjusting member and said release disc of said first adjusting member.

8. A device according to claim 1, wherein said release discs and said release members are coaxially mounted with respect to each other, one release member being in contact with one of said release discs and the other release member being in contact with the other of said release discs.

9. A sewing machine needle thread tensioning device, comprising a hollow pin having a shoulder, a first gripping disc on said pin abutting said shoulder, a second gripping disc on said pin opposing said first gripping disc, first and second release discs on said pin alongside said second gripping disc, an adjusting screw threaded on said pin, a first coil spring on said pin having its respective ends bearing against said first release disc and said adjusting screw, a stationary support bushing threadably engaged on said adjusting screw, an adjusting nut threaded on the exterior of said bushing, a second coil spring between said second release disc and said adjusting nut, said adjusting nut being threadable on said support bushing to provide a main tension on said second release disc through its associated spring.

10. A sewing machine according to claim 9, including a release sleeve engageable in the bore of said pin, a release bar slidable in said sleeve, each of said release discs having, in the bore of said pin, a crosspiece, said release bar and said sleeve being separately movable to move the crosspieces of each release disc against the force of the associated spring and release the tension on said gripping disc.

* * * * *